United States Patent [19]

Müller et al.

[11] 4,152,375

[45] May 1, 1979

[54] FUEL SUPPLY APPARATUS FOR EXTERNALLY IGNITED COMBUSTION ENGINES WITH CONTINUOUS FUEL ADDITION TO THE SUCTION PIPE

[75] Inventors: Hans-Jürgen Müller, Gelsenkirchen; Asoke Chattopadhay; Karl Schmidt, both of Neuss; Jürgen Römer, Meerbusch, all of Fed. Rep. of Germany

[73] Assignee: Pierburg GmbH & Co. KG, Neuss, Fed. Rep. of Germany

[21] Appl. No.: 886,918

[22] Filed: Mar. 10, 1978

[30] Foreign Application Priority Data

Apr. 19, 1977 [DE] Fed. Rep. of Germany ..... 2717230

[51] Int. Cl.[2] ..... F02M 9/12

[52] U.S. Cl. ..... 261/36 A; 123/140 MP; 261/39 D; 261/44 D; 261/50 A

[58] Field of Search ..... 261/50 A, 44 D, 36 A, 261/39 D; 123/140 MP

[56] References Cited

U.S. PATENT DOCUMENTS

| | | | |
|---|---|---|---|
| 2,544,111 | 3/1951 | Schneebeli | 261/44 D |
| 3,243,167 | 3/1966 | Winkler | 261/50 A |
| 3,273,869 | 9/1966 | Morton | 261/50 A |
| 3,288,445 | 11/1966 | Mennesson | 261/50 A |
| 3,710,771 | 1/1973 | Cinquegrani | 123/140 MP |
| 3,778,038 | 12/1973 | Eversole et al. | 261/36 A |
| 3,937,767 | 2/1976 | Chapman | 261/50 A |
| 3,953,548 | 4/1976 | Knapp et al. | 261/50 A |
| 4,058,100 | 11/1977 | Tanaka et al. | 261/50 A |

FOREIGN PATENT DOCUMENTS

| | | | |
|---|---|---|---|
| 683928 | 10/1939 | Fed. Rep. of Germany | 261/44 D |
| 791262 | 9/1935 | France | 261/44 D |

*Primary Examiner*—Tim R. Miles

*Attorney, Agent, or Firm*—Haseltine, Lake & Waters

[57] ABSTRACT

A fuel supply arrangement with a fuel metering valve for external-ignition combustion engines, in which continuous fuel addition is provided to the intake pipe. The latter has an air funnel acting jointly with a throttle member coaxially located and axially movable. The throttle member is adjustable against a restoring force via intake pipe underpressure acting in a working chamber which can be vented into atmosphere. The throttle member is actuated by a diaphragm located in a diaphragm housing having one chamber connected to the atmosphere, and having a second chamber at intake pipe underpressure. The second chamber can be vented to atmosphere by a valve having an actuation position which is arbitrarily variable through relative spatial arrangement of a tripping element on the throttle, and the valve. Either the tripping element or the valve is connected rigidly to the axially movable throttle member and the other one of these two elements is connected to an arbitrarily adjustable linkage of the gas pedal. The fuel is under a system pressure which is made variable by a pressure regulator as a function of one or several engine characteristics, and the fuel is delivered to a fuel exit by the fuel metering valve controlled as a function of the position of the throttle member.

8 Claims, 6 Drawing Figures

FUEL SUPPLY APPARATUS FOR EXTERNALLY IGNITED COMBUSTION ENGINES WITH CONTINUOUS FUEL ADDITION TO THE SUCTION PIPE

BACKGROUND OF THE INVENTION

The present invention relates to fuel supply apparatus with a fuel metering valve for mixture-compressing, externally or remotely ignited combustion engines. Continuous fuel delivery takes place to the suction (intake) pipe which has an air funnel or diffuser that operates jointly with a coaxially located and axially movable throttle body. The latter is adjustable in opposition to a restoring force via the suction pipe underpressure acting in a working chamber which can be vented to the atmosphere.

Such an apparatus is known from U.S. Pat. No. 2,544,111. However, this apparatus has the disadvantage that the fuel flow determined by the fuel metering valve (actuated by the gas pedal) determines the amount of valve opening for venting the working chamber by mechanical coupling via a linkage. This results in a mixture with a fuel ratio which does not correspond to the rate of air flow; as a result, under all load conditions except idling, there results a fuel ratio which does not correspond to the motor (engine) load condition since there is no direct association between air quantity and fuel quantity, and the fuel quantity depends solely on the position of the gas pedal. In addition, during load change in the partial load range, the position of the throttle body cannot be defined by the changing suction pipe underpressure; this is because there is continuous venting of the working chamber via the valve, causing forces varying in size and direction to act continuously on the thorttle body. Therefore, this device does not permit continuous acceleration in the partial load range.

It is, therefore, an object of the present invention to provide fuel supply apparatus where the fuel is added depending on the rate of air flow and on the suction tube pressure difference, with the throttle body controlling the fuel metering valve so that a predetermined fuel-air ratio is assured and the throttle body performs a stroke in accordance with the gas pedal position.

It is another object of the present invention to provide fuel supply apparatus of the foregoing character which is substantially simple in design and construction, and may be economically fabricated.

A further object of the present invention is to provide a fuel supply arrangement, as described, which may be readily maintained in service, and which has a substantially long operating life.

SUMMARY OF THE INVENTION

The objects of the present invention are achieved by providing a fuel supply arrangement having a fuel metering valve for gas-compression, external-ignition combustion engines with continuous fuel addition to the intake pipe. The latter is provided with an air funnel which acts cooperatively with a throttle that is coaxially located and is axially movable. The throttle, moreover, is adjustable against a restoring force, by means of intake pipe underpressure or vacuum acting in a working chamber which can be vented into atmosphere. The throttle is actuated by a diaphragm held in a housing in which there is one chamber connected to the atmosphere, and a second chamber is at intake pipe or manifold underpressure and can be vented to atmosphere through a valve. The action position of this valve is made arbitrarily variable as a result of relative spatial association of a tripping element and the valve.

Either the tripping element or the valve is rigidly connected to the axially movable throttle body, and the remaining one of these two elements is connected to an arbitrarily adjustable linkage of the gas pedal.

The fuel is held under system pressure that is variable as a result of a pressure regulator, dependent on one or more engine characteristics. The fuel flow is delivered to an exit via the fuel metering valve controlled as a function of the position of the throttle.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
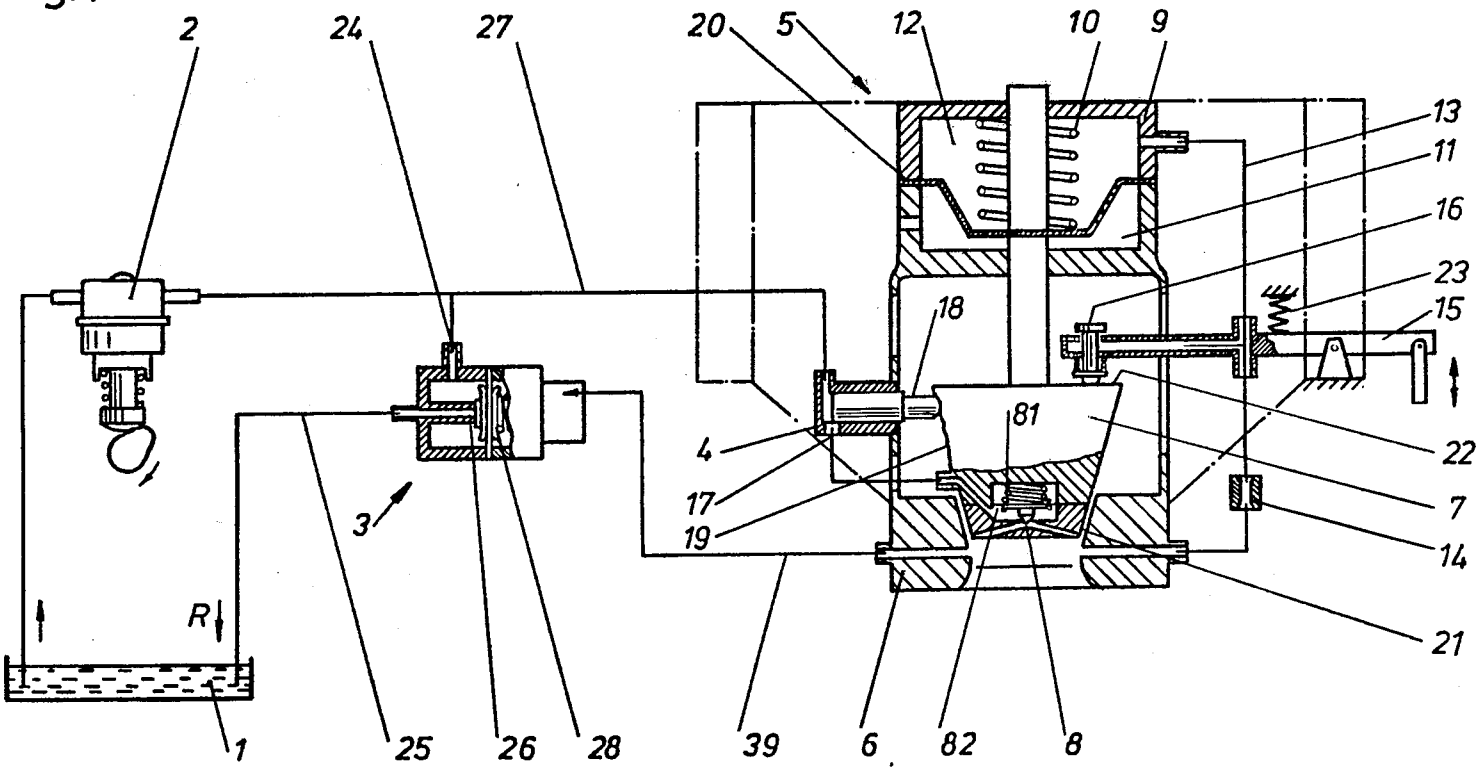
FIG. 1 is a first embodiment of the fuel supply device.

FIG. 1 shows a fuel supply device where the fuel travels from a tank 1 by means of a fuel pump 2, via a pressure regulator 3, to a fuel metering valve 4. The pressure regulator 3 placed in the fuel cycle is shown in a special embodiment in FIGS. 2 and 3 and its function will be explained further below. The fuel metering valve 4 is located on the carburetor 5 shown in FIG. 6. The latter is flange-mounted on the intake pipe (not shown) of an Otto engine. The carburetor 5 comprises an air funnel 6, a throttle body 7 located coaxially with this funnel and acting in conjunction with it. The throttle body 7 has a fuel exit 8 and is adjustable, via a diaphragm housing 9, axially against the force of a spring 10. The diaphragm housing 9 has a chamber 11. It is connected to the atmosphere. The working chamber 12 of the diaphragm housing 9 is connected via a line 13 and a fixed throttle 14 to the intake pipe.

FIG. 1 shows a linkage 15 actuated by the gas pedal; it adjusts the position of a disk valve 16, which in turn is connected to line 13, relative to the throttle body 7, as desired. The control cross section 17 of the fuel metering valve 4 is varied via a plunger 18 whose stroke is adjusted by means of a track 19 mounted on the throttle body.

The device operates as follows:

The intake pipe underpressure or vacuum reaches the working chamber 12 via throttle 14 located in line 13 and acts on the diaphragm 20. The throttle body 7 makes a stroke corresponding to the intake underpressure against the force of spring 10. This stroke determines the annular air gap 21 between diffuser 6 and throttle body 7 and also the fuel quantity which reaches the fuel exit 8, centered in the throttle body 7, via the fuel metering valve 4 controlled by the throttle body 7.

This exit 8 in accordance with FIG. 1 has a diaphragm valve which receives fuel and is opened against the force of a spring 81 by fuel acting on a diaphragam 82, as soon as the closing force of spring 81 is overcome.

In order to maintain a preset load condition, it is necessary to limit the mixture quantity. This is achieved by limiting the stroke of the throttle body 7 as a function of the gas pedal position by means of linkage 15. This is done by making the action point of the valve 16, which is a venting valve, arbitrarily variable by means of the relative spatial relation of tripping device 22 to valve 16, with the tripping device 22 in FIG. 1 being formed by the upper edge of the throttle body 7 and the valve 16 being connected to the arbitrarily adjustable gas pedal via the linkage 15 in such a way that it can be adjusted in the vertical direction. When the valve 16 via the arrangement just described has assumed an arbitrary preset position relative to the throttle body 7, the latter will carry out a stroke in accordance with the intake pipe underpressure till the tripping device 22 opens the valve 16. As a result, the working chamber 12 is vented via the line 13 and the throttle body 7 remains in its position while slightly pulsating. Because of the fixed throttle 14, the venting is effective since a larger air quantity flows in than is exhausted by the throttle 14. Also, the throttle 14 acts as a damper. To reduce engine power, the pressure on the gas pedal is reduced, mechanically moving the throttle body 7 by spring 10 in the vented working chamber 12 and via the linkage 15 by means of compression spring 23 in the direction of flow. The stroke limitation is applied to the partial load range of the combustion engine. In the full load range, the valve 16 is lifted so that there is no longer a contact with the tripping device 22. In this load range, the flow rate of air is in the subsonic range and the throttle body 7 operates as an air (quantity) meter, and hence adjusts its stroke depending on the air flowing through.

In the air gap 21, differing air pressure differentials appear with full load and partial load. Different rates of air flow occur for the same stroke of throttle body 7 and identical control cross section 17 of the fuel metering valve 4. This leads to mixing ratios which do not correspond to the engine requirement. To avoid this, the intake pipe underpressure influences the delivered fuel quantity via the pressure regulator.

Figure 4:
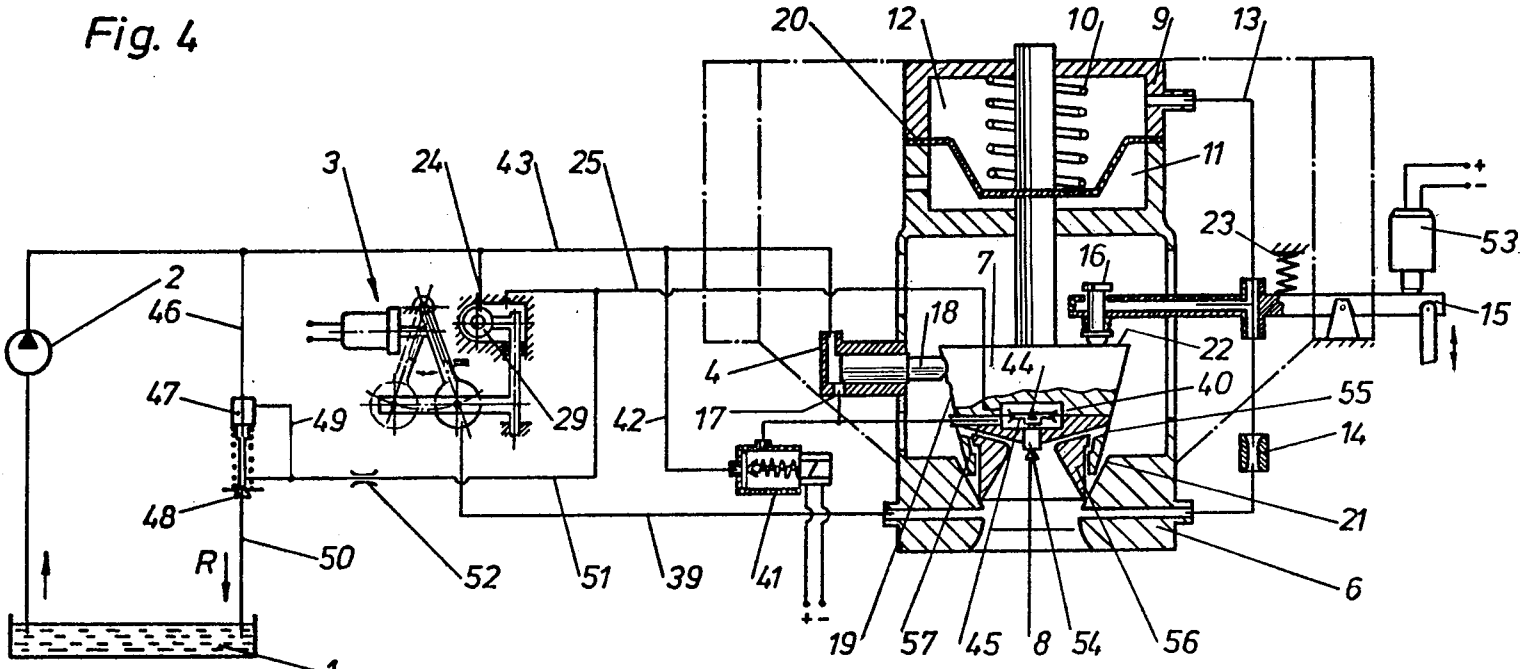
FIG. 4 shows a second embodiment.

In the embodiment of FIG. 1 this is achieved by having the system pressure of the device changed by the pressure regulator 3. As a result, different fuel quantities flow through the same control cross section. This quantity is aspirated (drawn) by the underpressure prevailing in air gap 21. FIG. 4 shows an arrangement for emulsification (mixture formation).

The pressure regulator 3 has an intake 24 branching off from the fuel line 27 and an outlet 25 serving as return to the tank 1. In the pressure regulator 3 there is a diaphragm-controlled valve 26 which, via engine characteristics, controls the fuel quantity flowing off and hence the system pressure in the line 27. The diaphragm 28 of valve 26 receives intake pipe underpressure via line 39. Further use of other engine coefficients are not shown in this example, but are easily conceivable. The intake pipe underpressure up until the range of high partial load is subject to changes which cause a corresponding change of the fuel-air ratio. At full load, the throttle body operates as pure air meter, the intake pipe underpressure remains constant and hence there is no system pressure change of the fuel in line 27. The fuel is metered solely via the control of valve 4 by means of track 19.

Figure 2:
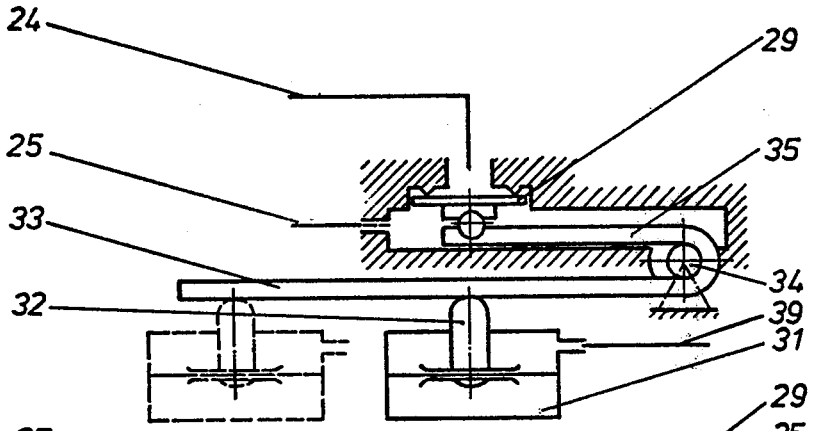
FIG. 2 shows a side view of a pressure regulator.
Figure 3:
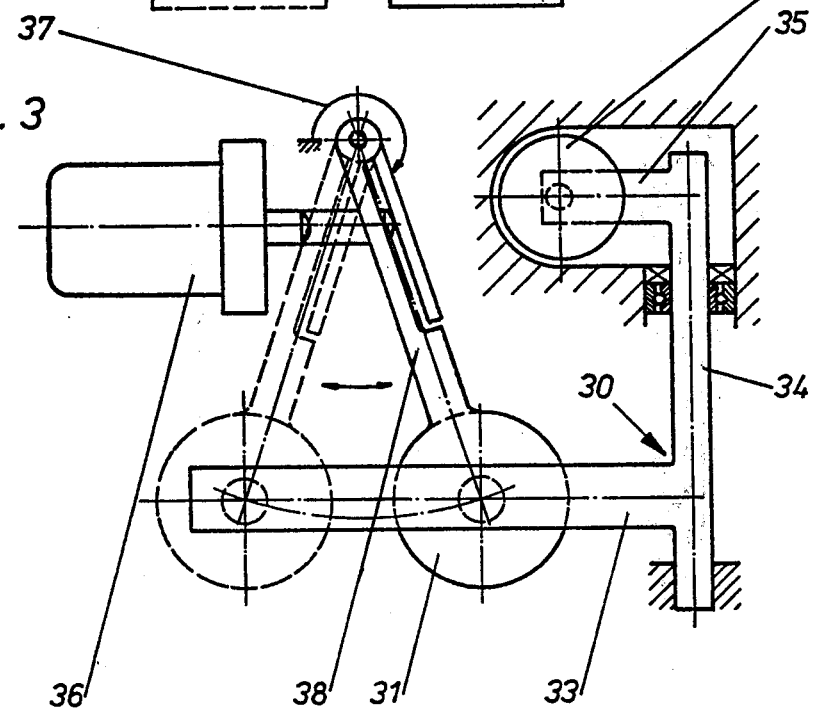
FIG. 3 shows a top view of the pressure regulator of FIG. 2.

FIGS. 2 and 3 show a pressure regulator which has a different construction from the one described above and is used in the fuel supply apparatus of FIG. 4.

The pressure regulator 3 has a differential pressure valve 29 located between intake 24 and outlet 25. This valve is connected via a U-shaped rocker 30 with a diaphragm housing 31 which is exposed to the intake pipe underpressure via line 39. The diaphragm plunger 32 acts on one leg 33 of rocker 30 and hence via shaft 34 and the second leg 35 on the differential pressure valve 29. Differential pressure valve 29 and diaphragm housing 31 are constructed so that their effective surface areas are equal so that a certain intake pipe underpressure change results in an equally large change of the fuel differential pressure. A fuel basic differential pressure, resulting in a full-load enrichment, may be provided, for example, by a spring. For the warmup range, the pressure regulator has a device which adds a constant percentage fuel quantity and during full load virtually a constant quantity. The diaphragm housing 31 mounted on a lever 38 can be moved by means of a thermal expansion element 36 along the leg 33 of the rocker 30 against the force of a spring, depending on the engine temperature. This changes the effective lever arm on leg 33, so that the point of force application of plunger 32 is shifted. Up into the high partial load region, the intake pipe underpressure is subject to changes which cause a corresponding change of the fuel differential pressure by means of the pressure regulator and hence a change of the fuel-air ratio. During acceleration, the throttle body 7 is freely movable and is displaced thereby adding more fuel through fuel metering valve 4. At full load, the throttle body 7 operates as pure air meter, the intake pipe underpressure remains constant, and hence there is no fuel differential pressure change. The fuel is measured solely via the control of valve 4 by means of track 19.

The embodiment of FIG. 4 differs from that of FIG. 1 mainly in that the fuel system is laid out differently. A partial fuel flow travels from the fuel pump 2 via the branch line 46 to a system pressure valve 47; the latter maintains the fuel pressure in the overall system at a fixed value. Valve 47 is coupled mechanically to a pressure maintenance valve 48 so that the system remains under pressure if the engine stops. The fuel from line 46, after opening valve 47, passes via a line 49 and the pressure maintenance valve 48 to the return line 50 to tank 1. The line 43, from which line 46 and line 24 branch off, leads to control cross section 17 of fuel metering valve 4. The intake line 24 leads to differential pressure valve 29 of pressure regulator 3. There the fuel pressure is changed in accordance with the engine characteristics and passes via the outlet line 25 as control pressure to the chamber 44 of a differential pressure valve 40. The line 25 is connected by a drain line 51 via a fixed throttle 52 to the return 50. The flow of control pressure fuel thus made possible, permits a change of the control pressure. In front (ahead) of the fuel exit 8 is a differential pressure valve 40 to which in chamber 44 is added control pressure supplied by line 25, while in chamber 45 the system pressure is added. The differential pressure valve 40 keeps the pressure differential at the control cross section 17 of fuel metering valve 4 constant. However, this pressure differential can be changed via the pressure regulator 3 depending on engine characteristics by means of the differential pressure valve 29. The function of the pressure regulator 3 has been described above. The fuel system has a magnetic valve 41 which opens a line 42 to bypass the fuel metering valve for cold starting. The fuel flows from the system pressure line 43 via the line 42 into chamber 45 of the differential pressure valve 40 and from there to the fuel exit 8.

To increase the speed with a cold engine, there is an electromagnet 53 which acts on the linkage 15.

The fuel exit 8 discharges via a valve 54 into the region of air channels 55 in an axially movable pre-atomizer and there forms an emulsion which is mixed in air gap 21 with the main air quantity. The pre-atomizer 56 is venturi-shaped and held in the throttle body 7 through an undercut. With a completely lowered throttle body 7, the pre-atomizer 56 makes contact with its lower region in the diffuser or air funnel 6 and the cross section of air channels 55 is reduced. If the engine operates in the lower partial load range, the throttle body 7 is lifted. Since it has free play relative to the pre-atomizer 56, which remains in its contacting position because of gravity, the cross section of air channels 55 is increased till the pre-atomizer is being taken along by a shoulder 57. More air is added for pre-atomizing to the emulsion during this stroke.

Figure 5:
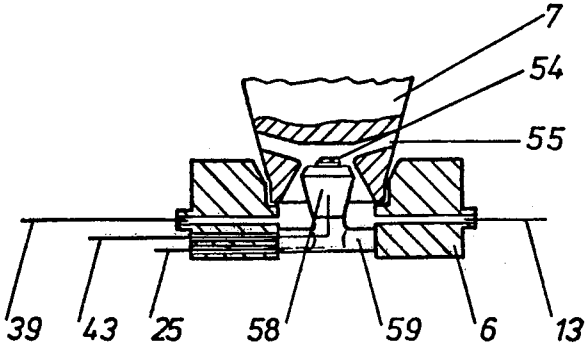
FIG. 5 shows the construction of FIG. 4 with a changed mixture exit.

FIG. 5 shows an embodiment of the mixture exit which achieves very good atomizing (diffusion) by increasing the relative speed between air and fuel by oppositely directed exit directions. The valve 54 is located with the differential pressure valve in a receiving body 58 which is held in the diffuser 6 by means of a bridge 59. Lines 25 and 43 are contained in the bridge 59. The receiving body 58 is centered in the diffuser 6.

Figure 6:
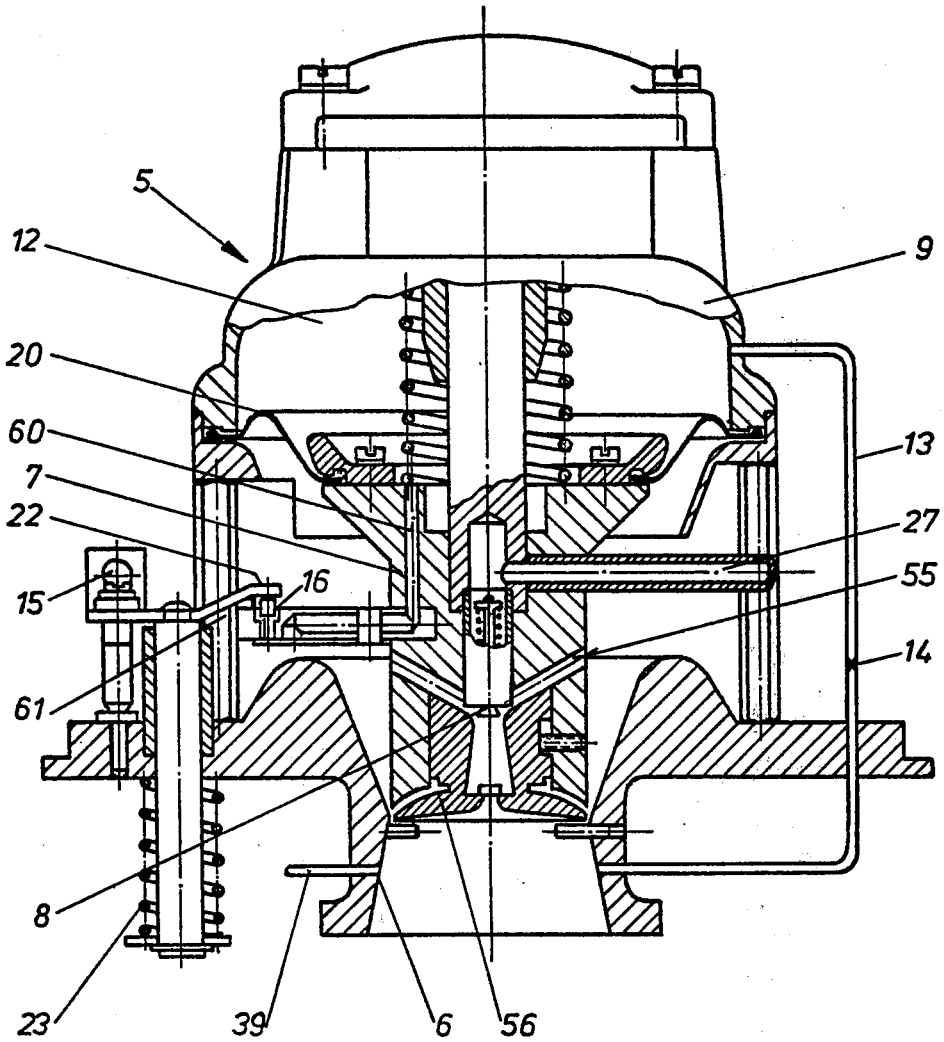
FIG. 6 shows the mixture forming device or carburetor.

FIG. 6 shows construction details of a mixture forming device (carburetor) 5 suitable for the fuel supply apparatus of FIG. 1. The reference numerals used for previous embodiments are continued in use and are not even expressly mentioned below since only differences are described. By using a differential pressure valve 40, this mixture forming device 5 can be easily used for the embodiment of FIG. 4. The main difference is that the venting valve, which in this case is a disk valve 16, which is connected to the working chamber 12 via a passage 60, is solidly fastened to the throttle body 7 and participates in its movement. The relative position of the tripping element 22 in relation to the valve 16 is changed via the linkage 15 actuated by the gas pedal. The tripping element 22 is provided with a finger which during the down stroke takes along the throttle body 7 through mechanical contact with the valve carrier.

One advantage of the present invention is that the underpressure regulation of the fuel system pressure or of the differential pressure compensate a hysteresis of diaphragm 20 or mechanical interference magnitudes by changing the intake pipe underpressure and related changes of the fuel quantity via the resulting fuel-air ratio. The fuel delivery is made because one throttle valve drops out in the presence of the fuel intake pipe underpressure. By controlling via valve 16 and the stroke of throttle body 7 adjusting itself according to the intake pipe underpressure, even when the gas pedal is quickly depressed, there can be no sudden underpressure drop, thus improving the driving action in comparison with mixture forming devices with throttle valves. The stroke limitation of the throttle body 7 via valve 16 has the advantage in the partial load range, that the maximum possible air differential pressure appears in air gap 21 which adapts the fuel quantity to the instantaneous engine requirement via pressure regulator 3.

Without further analysis, the foregoing will so fully reveal the gist of the present invention that others can, by applying current knowledge, readily adapt it for various applications without omitting features that, from the standpoint of prior art, fail to constitute essential characteristics of the generic or specific aspects of this invention, and therefore, such adaptations should and are intended to be comprehended within the meaning and range of equivalence of the following claims.

We claim:

1. A fuel supply arrangement with a fuel metering valve for external-ignition combustion engines, comprising: an intake pipe with continuous fuel addition to said intake pipe; said intake pipe having an air funnel and a throttle member coaxially located and axially movable, said air funnel acting jointly with said throttle member; a working chamber which can be vented to atmosphere, said throttle member being adjustable against a restoring force via intake pipe underpressure acting in said working chamber; said throttle member having a tripping element; a diaphragm housing having a diaphragm and two chambers; a valve element; an adjustable gas pedal linkage; said throttle member being axially moveable and being actuated by said diaphragm; one of said chambers being connected to atmosphere; the second one of said chambers being at intake pipe underpressure and being capable of being vented to atmosphere by said valve element; said valve element having a position of actuation arbitrarily variable by relative spatial arrangement of said tripping element and said valve element, one of said elements being rigidly connected to said throttle member and the other element being connected to said linkage.

2. A fuel supply arrangement as defined in claim 1 including a pressure regulator and a fuel metering valve; said fuel being under pressure varied by said pressure regulator as a function of at least one engine parameter; fuel exit means; said fuel being delivered to said fuel exit means via said fuel metering valve, said fuel metering valve being controlled as a function of the position of said throttle member.

3. A fuel supply arrangement as defined in claim 2 including a differential pressure valve in said pressure regulator and having a variable pressure differential for metering fuel dependent on the position of said throttle member at constant pressure differential and dependent on said engine parameter at a control cross section of said fuel metering valve.

4. A fuel supply arrangement as defined in claim 3 including a second diaphragm housing for controlling said differential pressure valve as a function of intake pipe underpressure.

5. A fuel supply arrangement as defined in claim 4 including U-shaped rocker means connecting said differential pressure valve and said second diaphragm housing; said rocker means having a leg; lever means; a thermal expansion element for actuating said lever means against the force of a spring dependent on engine temperature, said second diaphragm housing being movable along said leg of said rocker means by said lever means for changing the magnitude of an arm of said lever means.

6. A fuel supply arrangement as defined in claim 2 wherein said throttle member has a track for controlling said fuel metering valve.

7. A fuel supply arrangement as defined in claim 1 including pre-atomizer means in an opening in said throttle member, said throttle member having variable cross-section air channels discharging into said pre-atomizer means.

8. A fuel supply arrangement as defined in claim 1 including pre-atomizer means; a fuel delivery valve projecting into said pre-atomizer means; said throttle member having air channels discharging into said pre-atomizer means; said fuel delivery valve having an exit opposite to air flow; diffuser means and bridge means, said fuel delivery valve being held in said diffuser means by said bridge means.

* * * * *